US005099918A

United States Patent [19]

Bridges et al.

[11] Patent Number: 5,099,918

[45] Date of Patent: Mar. 31, 1992

[54] POWER SOURCES FOR DOWNHOLE ELECTRICAL HEATING

[75] Inventors: Jack E. Bridges, Park Ridge; George T. Dubiel, Wood Dale, both of Ill.

[73] Assignee: Uentech Corporation, Tulsa, Okla.

[21] Appl. No.: 646,514

[22] Filed: Jan. 25, 1991

Related U.S. Application Data

[63] Continuation of Ser. No. 322,911, Mar. 14, 1989, abandoned.

[51] Int. Cl.[5] ..... E21B 43/24

[52] U.S. Cl. ..... 166/60; 166/65.1; 363/37; 363/41

[58] Field of Search ..... 166/248, 65.1, 60, 53, 166/902; 219/277, 278; 363/37, 41

[56] References Cited

U.S. PATENT DOCUMENTS

| | | | |
|---|---|---|---|
| 2,799,641 | 7/1957 | Bell | 166/248 |
| 3,989,107 | 11/1976 | Fisher et al. | 166/248 |
| 4,010,799 | 3/1977 | Kein et al. | 166/248 |
| 4,084,638 | 4/1978 | Whiting | 166/248 |
| 4,303,128 | 12/1981 | Marr, Jr. | 166/65.1 X |
| 4,343,356 | 8/1982 | Riggs et al. | 166/60 |
| 4,444,255 | 4/1984 | Geoffrey et al. | 166/248 |
| 4,489,782 | 12/1984 | Perkins | 166/65.1 X |
| 4,495,990 | 1/1985 | Titis et al. | 166/65.1 |
| 4,667,738 | 5/1987 | Cadina | 166/248 |
| 4,721,897 | 1/1988 | Matsuse et al. | 363/37 X |
| 4,790,375 | 12/1988 | Bridges et al. | 166/60 |
| 4,816,985 | 3/1989 | Tanahashi | 363/37 X |
| 4,878,163 | 10/1989 | Yamab et al. | 363/41 X |
| 4,879,639 | 11/1989 | Tsukahara | 363/37 X |
| 4,911,239 | 3/1990 | Winckler et al. | 166/60 X |

FOREIGN PATENT DOCUMENTS

| | | | |
|---|---|---|---|
| 932657 | 8/1973 | Canada | 166/248 |

*Primary Examiner*—Hoang C. Dang

*Attorney, Agent, or Firm*—Kinzer, Plyer, Dorn, McEachran & Jambor

[57] ABSTRACT

Electrical power sources and systems for heating in or adjacent to an oil well or other mineral well, or for heating other earth media, each comprising an A.C. heating generator that generates an A.C. heating current at a selected heating frequency substantially different from the conventional 50/60 Hz frequency used by power companies; the heating generator may comprise an A.C. to D.C. converter for developing an intermediate D.C. output of predetermined amplitude from a conventional 50/60 Hz A.C. input, and a solid state switching circuit for repetitively sampling the D.C. output of the converter at the selected heating frequency, usually in a range of 0.01 Hz (or even lower) up to about 35 Hz. A heating rate control varies the energy content and the frequency of the A.C. output to suit well requirements. Each power source or system includes output connections for connecting the output of the heating generator to a normally inaccessible main heating electrode, usually located downhole in a well, and to a return electrode; most have the capability of including a very small controllable D.C. component in the output.

3 Claims, 7 Drawing Sheets

POWER SOURCES FOR DOWNHOLE ELECTRICAL HEATING

This is a continuation of copending application Ser. No. 07/322,911 filed on Mar. 14, 1989, now abandoned.

BACKGROUND OF THE INVENTION

In-place reserves of heavy oil in the United States have been estimated about one hundred fifty billion barrels. Of this large in-place deposit total, however, only about five billion barrels may be considered economically produceable at current oil prices. One major impediment to production of oil from such deposits is the high viscosity of the oil. The high viscosity reduces the rate of flow through the deposit, particularly in the vicinity of the well bore, and consequently increases the capital costs per barrel so that overall costs per barrel become excessive.

Various techniques have been tried to stimulate flow from wells in heavy oil deposits. One technique utilizes steam to heat the oil around the well; this method has been utilized mostly in California. However, steam has drawbacks in that it is not applicable to thin reservoirs, is not suitable for many deposits which have a high clay content, is not readily applicable to off-shore deposits, and cannot be used where there is no adequate water supply.

There have also been a number of proposals for the use of electromagnetic energy, usually at conventional power frequencies (50/60 Hz) but sometimes in the radio frequency range, for heating oil deposits in the vicinity of a well bore. In field tests, it has been demonstrated that electromagnetic energy can thus be used for local heating of the oil, reducing its viscosity and increasing the flow rate. A viscosity reduction for oil in the immediate vicinity of the well bore changes the pressure distribution in the deposit to an extent such that flow rates may be enhanced as much as three to six times.

Perhaps the most direct and least costly method of implementation of electromagnetic heating of deposits in the vicinity of a well bore utilizes existing oil well equipment and takes advantage of conventional oil field practices. Thus, conventional steel well casing or production tubing may be employed as a part of a conductor system which delivers power to a main heating electrode located downhole in the well, at the level of the oil deposit. However, the high magnetic permeability of a steel casing or tubing, with associated eddy current and hysteresis losses, often creates excessive power losses in the transmission of electrical energy down the well to the main electrode. Such power losses are significant even at the conventional 50/60 Hz supply frequencies that are used almost universally. These losses may be mitigated by reducing the A.C. power frequency, as transmitted to the downhole heating electrode, but this expedient creates some substantial technical problems as regards the electrical power source, particularly if the system must be energized from an ordinary 50/60 Hz power line.

Various power sources could be used for low frequency electromagnetic heating of the producing deposits around oil wells or other mineral fluid wells; for example, a conventional motor generator set could be employed. To generate really low frequencies by means of a motor generator set, as in a range below thirty-five Hz, however requires a very large generator that incorporates a great deal of iron. As a consequence, such a motor generator set is unduly costly and may also be quite difficult to maintain.

Another possible heating source is an amplifier of the conventional audio frequency type. In a source of this kind the usual 50/60 Hz power line voltage is first rectified and is then used to energize a conventional but high power audio frequency amplifier operating at the desired low frequency. But a power source of this kind is not really desirable because such amplifiers are relatively wasteful, usually operating at efficiencies of only about sixty to eighty percent.

Even if such conventional low frequency power sources were otherwise acceptable, their routine application to heating the producing zone around the wellbore of a heavy-oil well may pose costly difficulties. The nature of the formations and the flow rates of the produced fluids change. Such changes may lead either to formation damage or to damage or destruction of the downhole equipment. A small and controllable D.C. component, in combination with the larger low frequency A.C. heating current, may also be needed for corrosion protection. This might be accomplished by placing a conventionally designed controllable source of D.C. power in series with one of the aforementioned conventionally designed sources of low frequency A.C. power, but the cost of such a D.C. supply, which would have to be capable of withstanding hundreds of amperes of low frequency A.C. current, is excessive and renders such conventional equipment impractical. Furthermore, such combinations of conventionally designed equipment are not likely to meet the requirements of electric power utilities for minimizing power rates while simultaneously being responsive to changes occurring in the formations being heated or to variations of the specific heat or flow rates of the produced fluids.

There is another type of oil well heating system in which the heat is applied to the flow of oil within the well itself, rather than to a localized portion of the deposit around the well. Such a heating system, usually applied to paraffin prone wells but also applicable to other installations, is described in Bridges et al U.S. Pat. No. 4,790,375 issued Dec. 13, 1988. In a system of this kind the heating element or elements constitute the well casing, the production tubing, or both; the high hysteresis and eddy current losses in steel tubing may make its use advantageous. In such systems it may be desirable to supply heating power to the system at frequencies substantially above the normal power range of 50/60 Hz; otherwise, the problems may be similar to the low frequency systems previously mentioned.

SUMMARY OF THE INVENTION

It is a primary object of the present invention, therefore, to provide a new and improved power sources and systems that preferably can be powered from conventional 50/60 Hz supplies, for electromagnetic earth formation heating as used in an oil well, another mineral fluid well, or in other recovery arrangements for processing earth materials, which sources have operating frequencies substantially different from and usually much lower than the conventional 50/60 Hz supply frequency; these power sources and systems should be simple and economical in construction, reliable in operation over extended periods of time, and simple and inexpensive to maintain. Moreover, they should maintain a power factor within effective economic limits, keep the peak-to-average power ratio below two, and preclude excessive heating while maximizing production.

Another object of the invention is to provide a new and improved power source for energizing an electromagnetic heating system in an oil well, at a heating frequency substantially different from the conventional 50/60 Hz supply frequency, that affords superior economic and operational characteristics in a very low frequency range, from 0.01 Hz or even lower up to about 35 Hz.

Accordingly, the invention relates to an electrical heating power source for a heating system for heating in or adjacent to an oil well or other mineral fluid well, or for heating other earth media, the heating system including the power source, a main electrode positioned in the earth adjacent a mineral fluid deposit or other location to be heated, and a return electrode. The power source comprises A.C./D.C. conversion means for developing a D.C. output of predetermined amplitude from a conventional 50/60 Hz power input, input connection means for connecting the conversion means to a 50/60 Hz supply, solid state switching means, connected to the conversion means, for repetitively sampling its D.C. output at a heating frequency substantially different from 50/60 Hz to develop an A.C. output at the heating frequency, and heating control means, connected to the switching means, for controlling the heating frequency and for the energy content of the A.C. output. The power source further comprises output connection means for connecting the A.C. output of the switching means to the electrodes. The preferred power frequency range is usually 0.01 to 35 Hz, with a very small D.C. component.

DESCRIPTION OF THE PREFERRED EMBODIMENTS

Figure 1:
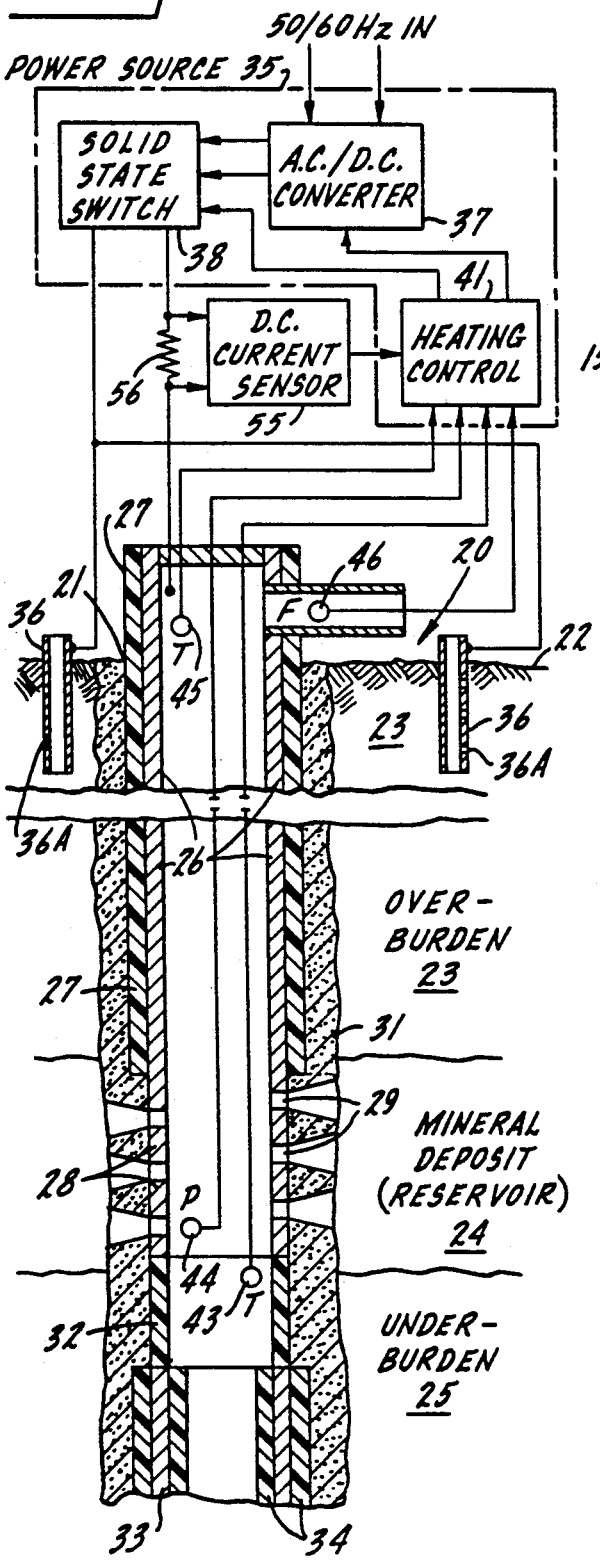
FIGS. 1 and 2 are simplified schematic sectional elevation views of two different oil wells, each equipped with a downhole electromagnetic heating system energized from a power source constructed in accordance with the present invention.

FIG. 1 illustrates a mineral well 20, specifically an oil well, that comprises a well bore 21 extending downwardly from a surface 22 through an extensive overburden 23, which may include a variety of different formations. Bore 21 of well 20 continues downwardly through a mineral deposit or reservoir 24 and into an underburden formation 25. An electrically conductive casing 26, usually formed of low carbon steel, extends downwardly into well bore 21 from surface 22. Casing 26 may have an external insulator layer 27 from surface 22 down to the upper level of deposit 24. The portion of casing 26 that traverses the deposit or reservoir 24 is not covered by an insulator; it is left exposed to afford a heating electrode 28 that includes a multiplicity of apertures 29 for oil to enter casing 26 from reservoir 24.

Casing 26 and its external insulation 27 may be surrounded by a layer of grout 31. In the region of deposit 24, the grout should have openings aligned with the apertures 29 in electrode 28 so that it does not interfere with admission of oil into casing 26. Alternatively, the grouting may be discontinued in this portion of well 20. From the lower part of reservoir 24, extending into underburden 25, there is a casing section 32 of an electrical insulator, such as resin-impregnated fiberglass, as an extension of casing 26. Below the insulation casing section 32 there may be a further steel casing section 33, preferably provided with internal and external insulation layers 34, as described in greater detail in Bridges et al U.S. Pat. No. 4,793,409, issued Dec. 27, 1988, which also discloses preferred methods of forming the insulation layer 27 on casing 26.

Oil well 20, FIG. 1, has an electromagnetic heating system that includes a heating power source 35 supplied from a conventional electrical supply operating at the usual power frequency of 50 Hz or 60 Hz, depending upon the country in which oil well 20 is located. The heating system for well 20 further comprises the main heating electrode 28, constituting an exposed perforated section of casing 26, and a return electrode shown as a plurality of electrically interconnected conductive electrodes 36 each preferably having plural perforations 36A and each extending a substantial distance into the earth from surface 22. Electrodes 28 and 36 are electrically connected to power source 35.

Power source 35 includes an A.C. to D.C. converter 37 connected by appropriate means to the external 50/60 Hz electrical supply line. Converter 37 develops an intermediate D.C. output and supplies it to a switching circuit 38, preferably a solid state switching circuit, that repetitively samples the intermediate D.C. output from the converter at a preselected heating frequency to develop an A.C. heating current that is applied to electrodes 28 and 36. The connection to electrode 28 is made through casing 26, of which electrode 28 is a component part.

Power source 35 additionally comprises a heating control circuit 41 connected to converter 37 and to solid state switch unit 38. Control circuit 41 maintains the sampling rate for the switches in circuit 38 at a frequency substantially different from 50/60 Hz; in well 20, this sampling rate is preferably in a range of about 0.01 Hz or even lower, up to about 35 Hz. For most well installations the heating power frequency range can be appreciably smaller, usually between two and twenty Hz.

The heating control 41 in well 20 has inputs from one or more sensors, all sensing parameters that are related to the flow rate of well 20 or to the physical condition of the heated zone in reservoir 24. Such sensors may include a temperature sensor 43 and a pressure sensor 44 positioned in the lower part of casing 26 to sense the temperature and pressure of fluids in this part of the well. A thermal sensor 45 may be located near the top of the well, as may a flow sensor 46. Control circuit 41 adjusts the power content and frequency of the A.C. power output delivered from switching unit 38 to electrodes 28 and 36, based on inputs from sensors such as devices 43–46, as described hereinafter. Heating control 41 may also receive an additional input from a D.C. current sensor 55 connected to a resistor 56 in the heating circuit to provide for control of a low amplitude D.C. corrosion current as described in the co-pending application of Bridges et al, Ser. No. 322,930, filed concurrently herewith, now U.S. Pat. No. 5,012,868.

Figure 2:
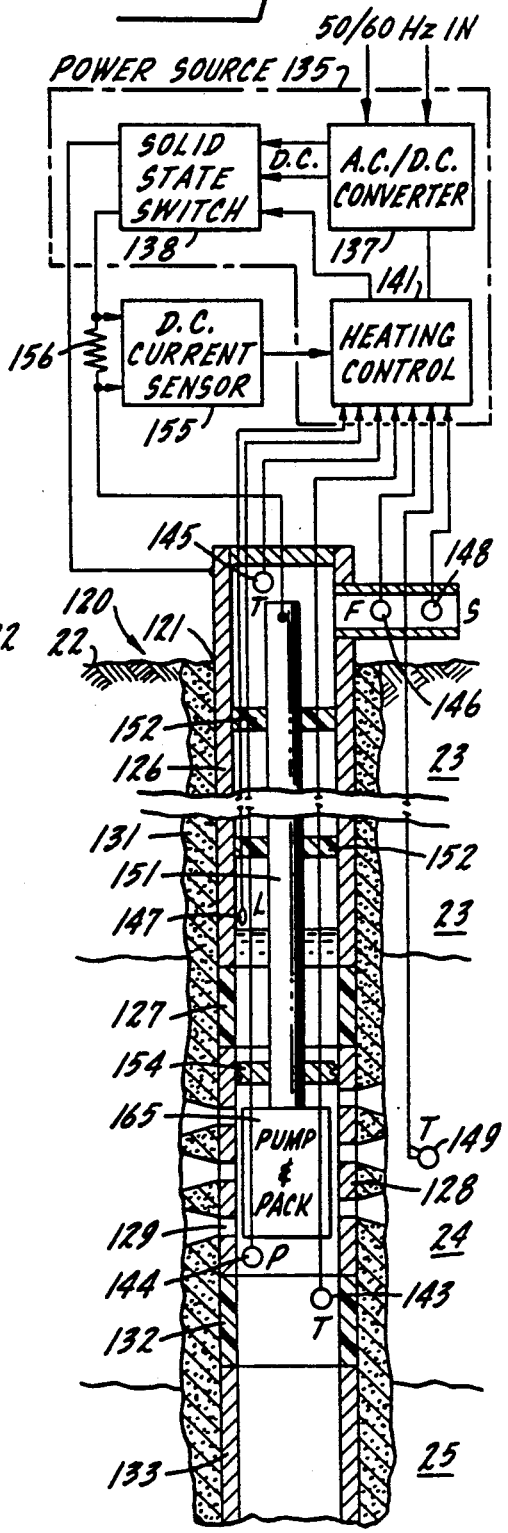

FIG. 2 illustrates another well 120 comprising a well bore 121 again extending from surface 22 down through overburden 23 and deposit 24, and into underburden 25. Well 120 has a steel or other electrically conductive casing 126, which in this instance has no external insulation; casing 126 is encompassed by a layer of grout 131. Electrical conductivity of the well casing is interrupted by an insulator casing section 127 preferably located just within the mineral deposit 24. A further conductive casing section 128 extends below section 127. Casing section 128 is provided with multiple perforations 129 and constitutes a main heating electrode for heating a part of deposit 24 immediately adjacent well 120. An insulator casing 132 extends down toward the rathole of well 120, at the bottom of reservoir 24. The rathole of well 120, in underburden 25, may also include an additional length of conductive casing 133, in this instance shown uninsulated.

The electrical heating system for well 120, including its power source 135, is similar to the system for well 20 of FIG. 1, except that there are no separate return electrodes. In well 120, FIG. 2, casing 126 serves as the return electrode and is electrically connected to a solid state switching unit 138 in power source 135. Switching unit 138 is connected to an A.C. to D.C. conversion circuit 137, in turn connected to a conventional 50/60 Hz supply. Power source 135 includes a heating control 141, shown as having inputs from a downhole temperature sensor 143, a pressure sensor 144, a well head temperature sensor 145, and an output flow sensor 146. A further input to control 141 may be derived from a liquid level sensor 147 in the annulus between casing 126 and a production tubing 151 in well 120. Liquid level information may also be developed from a sonic impulse sensor, located in the wellhead, measuring the transit times for sonic pulses radiated downwardly and reflected from the liquid surface. Other inputs to heating control 141 may be derived from a specific heat sensor 148 shown located in the output conduit from well 120 or from a thermal sensor 149 positioned in deposit 24. Further control signals may also be derived from the ratio of the heating voltage and current supplied to the well. For a well utilizing a controlled low-amplitude D.C. current for corrosion inhibition, a D.C. current sensor 155, 156 may be provided.

In well 120 the central production tubing 151 extends down through casing 126 to the level of the oil deposit 24. A series of electrical insulator spacers 152 isolate production tubing 151 from casing 126 throughout the length of the tubing. Tubing 151 is formed from an electrical conductor; aluminum tubing or the like is preferably employed but steel tubing may also be used. In some wells, tubing 151 may be insulated to preclude electrical contact with liquids in the well casing.

Adjacent the top of deposit 24, in FIG. 2, the insulator casing section 127 isolates the upper casing 126 from the main heating electrode 128 of well 120. An electrically conductive spacer and connector 154, located below insulator casing section 127, provides an effective electrical connection from tubing 151 to electrode 128. Connector 154 should be one that affords a true molecular bond electrical connection from tubing 151 to the electrode, casing section 128. A conventional pump and gravel pack 165 may be located below connector 154.

The wells shown in FIGS. 1 and 2 will be recognized as generally representative of a large variety of different types of electromagnetic heating systems applicable to oil wells and to other installations in which a portion of a mineral deposit is heated in situ. Thus, the return electrode for well 20 could be the conductive casing of another oil well in the same field, rather than the separate return electrodes 36. In this specification any reference to the wells and heating systems of FIGS. 1 and 2 should be understood to encompass this and other reasonable variations of the well and the well heating system.

Electromagnetic downhole heating systems for oil wells, other fluid wells, and the like are quite complex in their functional attributes, particularly in view of the critical economic requirements they must meet to be of practical value. In particular, downhole heating cannot be accomplished by simply applying a fixed-level power input; a fixed power input leads almost inevitably to failure, frequently of a disastrous nature. Thus, the power supplied for downhole heating must be varied to meet changes in operating conditions in and around the well if the heating system is to be effective and reasonably efficient.

For example, a well producing only ten barrels daily, mostly oil, may require a power input of the order of three to five kilowatts for optimum efficiency. A similar well, or even the same well at a different time, also producing only ten barrels per day but mostly water, would require heating at a rate of eight to ten kilowatts to achieve the same downhole temperature rise. For wells producing one hundred barrels per day, the power input requirements increase approximately proportionally. The flow rate and the composition of the fluid being pumped may change in any well, requiring changes in power source operation to maintain optimum efficiency. Such changes usually occur slowly, but rather rapid changes are possible.

Other variable factors further complicate the design and operation of the downhole heating system and its power source. For example, the input impedance to the well, or rather to its electrode system, is a function of the conductivity of the media in which the main electrodes are positioned, and intervening formations as well. But the conductivity of such media changes with temperature, other things being equal, roughly doubling or tripling for every 150° F. temperature increase. The spreading resistance of the main, downhole heating electrode (e.g. 28 or 128) is also a variable; it is a function of the conductivity of the reservoir fluids. This may change drastically with changes in the oil/water ratio; as the oil/water ratio decreases, conductivity increases.

Thus, it should be appreciated that in electromagnetic systems for heating oil wells, other mineral fluid wells, or other earth formations, limits on the maximum heating rate of the system are necessary to assure extended life and to avoid damage or improper operation due to overheating. Conversely, minimum heating rate limits should be maintained to assure derivation of some benefit from the system. Inadequate heating is quite wasteful; excessive heating can ruin the well or other such installation. That is the reason for the sensors (e.g., devices 43–46 in FIG. 1, devices 143–149 in FIG. 2) and use of their sensed information in the power sources of the present invention, as described hereinafter.

One maximum temperature that limits permissible operation of an oil well like wells 20 and 120, FIGS. 1 and 2, is the water vaporization temperature $T_v$. This temperature limit, in degrees Fahrenheit, may be determined by the relationship $$T_v = 180 \log_{10} P_E$$

for an oil well, where $P_E$ is the fluid pressure near the main heating electrode, in pounds per square inch absolute. See sensor 44, FIG. 1. In a well pressured by gas, the relationship is $$T_v = 180 \log_{10} [P_s + 0.43h],$$

in which $P_s$ is the fluid pressure (gas) in pounds per square inch absolute. This pressure may be measured at the well head. In this relationship h is the height of the liquid in the annulus above the main electrode, in feet. See sensor 147, FIG. 2.

These parameters provide one upper limit for heating of the deposit or reservoir, to be compared with an actual sensed temperature at the main electrode. The actual temperature may be sensed directly, as by sensors 43 and 143 (FIGS. 1 and 2). In some systems, sensing of the temperature at the well head may afford an adequate basis for estimation of the downhole temperature, permitting use of thermal sensors at locations 45 and 145.

Other operating limits, which may be higher or lower than the vaporization temperatures given above, can be used, particularly if temperature measurements are impractical or unreliable. Thus, in an oil well the maximum average power input $W_{max}$ should be held below $$W_{max} = 10^{-2}\left(1 - \frac{k}{2}\right)[(180 \log_{10} P_E) - T_R]Q + 10 \text{ kw}$$

where k = oil/water ratio, $T_R$ = temperature in the reservoir, and

Q = flow rate in barrels/day.

For this relationship a poor delivery efficiency of about fifty percent is assumed, with an approximate steady state thermal conduction loss in the system of five kw (10 Kw at 50% efficiency). The minimum power $W_{min}$ is $$W_{min} = (5 \times 10^{-3})\left(1 - \frac{k}{2}\right)20Q + 3 \text{ kw}.$$

This assumes a delivery efficiency of about ninety percent, a steady state heat loss of 2.7 kw, and a minimum useful operating temperature change ($T_H - T_R$) of 20° F., $T_H$ being the reservoir temperature, near the well bore, when heated.

Sensing of the oil/water ratio (factor k in the above heating rate parameters) by occasional measurement of the volumes of oil and water produced is not suitable. Direct, on-line sensing is highly preferable, especially for high flow rate wells. Actually, because the specific gravities of oil and water are similar the matter of real interest is the specific heat of the fluid being delivered from the well. The specific heat may vary widely, from a high oil-low water fluid mixture to a fluid that includes more water than oil. Thus, a sensor that detects specific heat (e.g. sensor 148, FIG. 2) affords a usable approximation of the oil/water ratio. For some oil fields, on-line measurement of the temperature and conductivity of the produced fluids can provide data from which the oil/water ratio or specific heat may be derived.

In some deep wells with high solution gas or drive pressure, the height of the fluids in the annulus may be so great that other temperature thresholds are exceeded, other than the vaporization temperature of water at the well pressure. Two other temperature limits are the insulation withstand temperature and the maximum allowable temperature before partial pyrolysis of the oil occurs. Such pyrolysis can cause coking and formation damage.

In all of the power sources of the invention, effective operation at a frequency other than the conventional 50/60 Hz power frequency is required. For most applications, involving heating of a deposit adjacent a well, the frequency is reduced to a range of 0.01 to 35 Hz to minimize losses due to use of ordinary steel pipe (well casing and/or production tubing) for delivery of power downhole. For very deep wells, the A.C. heating frequency may have to be reduced even lower than 0.01 Hz; for shallow wells, a higher frequency up to about 35 Hz may be acceptable. In most wells a very small and controllable D.C. current is also desirable for corrosion protection and to control electro-osmosis effects around the heating electrodes.

Although very deep oil wells may decrease the lowest A.C. operating frequency requirement to the order of 0.01 Hz, the requirements to supply D.C. for either corrosion control purposes or for electroosmotic enhancement of production may reduce the frequency requirement more nearly to zero. In the case where electroosmosis is used to aid the production of oil or to suppress water coning, the value of the D.C. component can be quite large, relative to the A.C. component. On the other hand, in cases where corrosion control is required, the amplitude of the D.C. component is small compared to the A.C. component. In either case the power supply must be capable of transmitting A.C.

With these considerations in mind, the power sources of the present invention can be considered.

Figure 3:
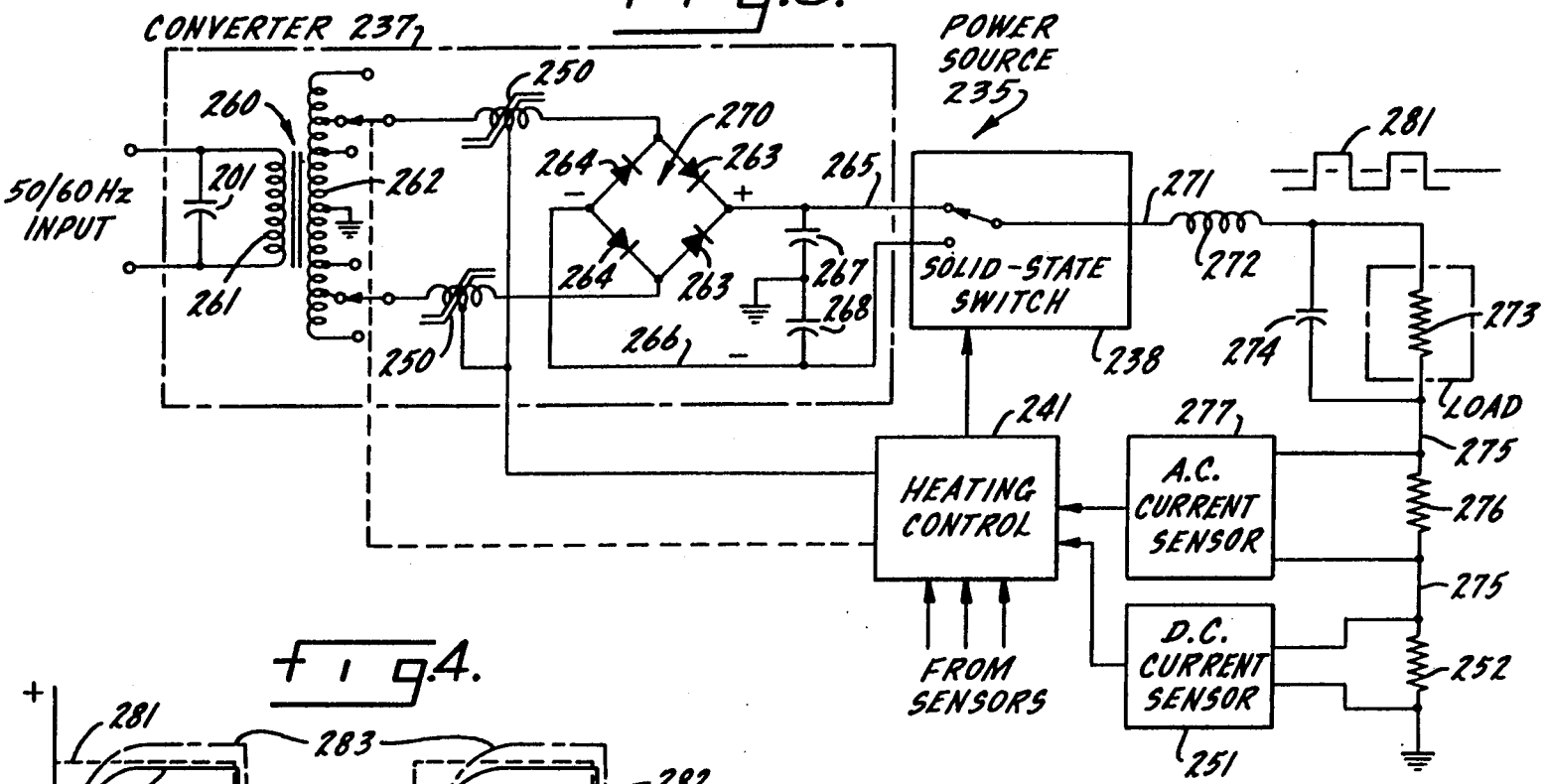
FIG. 3 is a schematic diagram of a simple, single phase heating power source constructed in accordance with one embodiment of the invention.

FIG. 3 illustrates a simple, single-phase power source 235 that may be utilized in the electromagnetic well heating systems of FIGS. 1 and 2. Power source 235 includes an A.C. to D.C. converter 237 that comprises an input transformer 260 having a primary winding 261 connected to an appropriate single phase 50/60 Hz power line input. Transformer 260 has a multi-tapped, balanced secondary winding 262, the center of winding 262 being connected to ground. Preferably, a capacitor 201 is connected in parallel with primary winding 261 for power factor correction and for suppression of harmonics that might otherwise be reflected back into the power line supplying transformer 260.

Converter 237 of power source 235 further comprises a rectifier bridge circuit 270 including two forwardly polarized diodes 263 and two reverse polarized diodes 264. Each of the taps of the secondary winding 262 of transformer 260 is connected to one of the input terminals of bridge 270. On the output side of bridge 270, the cathodes of diodes 263 are connected together to a positive polarity output line 265 that is connected to a switch unit 238, preferably a solid-state switching circuit. Similarly, the anodes of bridge diodes 264 are connected together and to a negative conductor 266 that is also connected to the solid state switch unit. A pair of filter capacitors 267 and 268 are connected from conductors 265 and 266, respectively, to ground. Preferably, a pair of saturable reactors 250 are connected between bridge 270 and the taps on transformer 260.

Switch unit 238 may include any desired form of switching apparatus (preferably solid state) that is capable of handling the high amplitude A.C. currents, frequently in the range of 50 to 1000 amperes, necessary for effective electromagnetic heating of an oil well or other mineral well. Thus, the switching devices used in unit 238 (not shown in detail) may comprise gated turn off (GTO) thyristors or power transistors. It may be necessary to use a plurality of such switching devices in parallel or in series in order to provide adequate current-carrying capacity or voltage withstand capability for switch unit 238. Of course, it will be recognized that it may also be necessary to afford a plurality of diodes, in series or in parallel with each other, in each polarity, to obtain adequate capacity in bridge 270 of converter 237.

The output conductor 271 from solid state switch unit 238 is connected through a frequency limiting inductance 272 to a load, shown in FIG. 3 as a resistance 273. Load 273 represents the heating energy conductors, the main heating electrode, the return electrode, and intervening heated formations in the heating systems for the oil wells as previously described. Thus, load 273 represents the overall impedance of casing 26, main heating electrode 28, electrodes 36, and the formations between the electrodes in well 20 of FIG. 1. Similarly, for FIG. 2, load 273 of FIG. 3 represents the total impedance of tubing 151, connector 154, main heating electrode 128, casing 126 (serving as the return electrode) and the formations between electrodes 128 and 126. Of course, the heating circuit in each instance may include some capacitance, shown as a capacitor 274 connected in parallel with load 273. Additional capacitance may be provided to limit application of undesired high frequency energy to load 273, with resultant unwanted losses.

The load circuit 272–274 for switch unit 238 is returned to ground by a conductor 275. A low resistance 276 may be connected in series in conductor 275, serving as the input to an A.C. current sensor 277. The output of current sensor 277 is supplied to a heating control circuit 241 that is utilized to control the frequency and duty cycle for the solid state switches in unit 238 and that also controls the taps on the secondary winding 262 of transformer 260 in converter 237. An output from heating control 241 is also connected to reactors 250. Heating control circuit 241 should also be provided with inputs from the sensors in the oil well, such as sensors 43–46 in FIG. 1 and sensors 143–149 in FIG. 2. For a well using a low-amplitude D.C. current for corrosion inhibition a D.C. current sensor 251 and appropriate input resistor 252 may be provided.

Power source 235, FIG. 3, affords an inexpensive but reliable power source for an electromagnetic oil well heating system. Electrical energy derived from the 50 or 60 Hz conventional power supply, through transformer 260, is rectified in the bridge circuit 270 of conversion circuit 237; the intermediate D.C. output from the conversion circuit is smoothed by filter capacitors 267 and 268. Thus, the filtered intermediate D.C. output from converter unit 237 is supplied with a positive polarity (line 265) and a negative polarity (line 266) to switch unit 238. The main heating electrode in the deposit in the well, such as electrode 28 of FIG. 1 or electrode 128 of FIG. 2, is alternately switched to the positive polarity and the negative polarity by switch unit 238, at a frequency determined by appropriate circuits, including a local oscillator, in heating control 241; in wells like those of FIGS. 1 and 2 a low frequency, as in a range of 0.01 Hz or even lower, up to 35 Hz, is preferred because it affords a material improvement in efficiency by greatly reducing eddy current and hysteresis losses in casing 26 (FIG. 1) and in casing 126 and tubing 151 (FIG. 2). In most wells, the optimum power frequency is in a more limited range, about two to twenty Hz; the extended range is needed only for unusual well conditions. In particular, the deeper (or longer) the well, the lower the desired frequency. Energization of the heating circuit is effected by an A.C. square wave 281 as shown in FIG. 3 and as shown in idealized form by the dash line representation 281 in FIG. 4. The series inductance 272 is effective to suppress high frequency components of the square wave.

Figure 4:
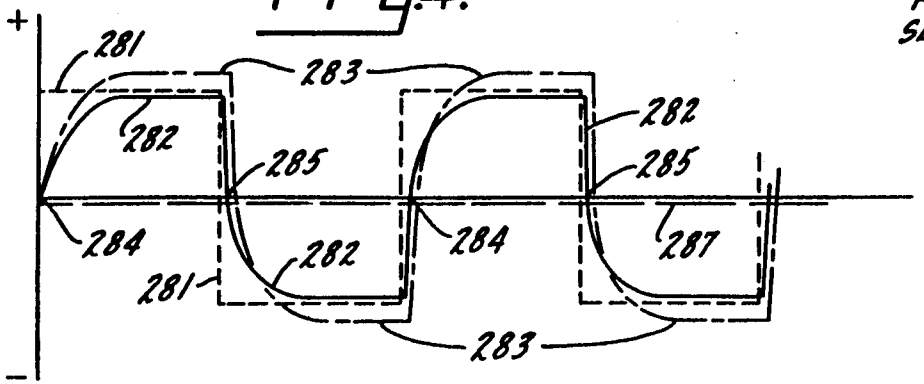
FIG. 4 is an electrical waveform diagram used in explanation of operation of FIG. 3.

In FIG. 4, the solid line curve 282 affords a more realistic representation of the actual waveform of the low frequency A.C. power supplied to load 273 in power source 235, FIG. 3. As shown by curve 282, in each half cycle the amplitude of the current increases rapidly when the switching device or devices in unit 238 are driven to ON condition for a given polarity; see the rapid positive-polarity amplitude increases from points 284 and similar rapid negative increases from points 285. When the current reaches a peak level it stays at that level until the end of the half cycle, then decreases rapidly and begins the buildup of current to a peak of the opposite polarity.

To adjust the heating rate for the system represented by load 273 in FIG. 3, one quite effective form of control is to vary the setting of the output taps for transformer secondary 262. One such change, to an increased power level, is shown in FIG. 4 by the phantom line curve 283. Multiple changes of this sort can be provided by appropriate construction of transformer 260. The power level changes may be controlled directly by heating control 241, as shown in FIG. 3; in many instances, adequate control is afforded if unit 241 merely correlates the input data from its sensors, with the transformer tap changes made manually based on a readout from control 241. The heating control also applies a saturation current to reactors 250 for reduction of the heating rate and compensation for a lagging power factor.

Another power modification may be accomplished by delaying the initiation of conduction in one-half cycle, in switch unit 238, relative to the other. In this way, by limited variations in the relative durations of the positive and negative half-cycles in the power output, curves 282 and 283, a small but closely controlled D.C. component 287 can be introduced into the electrical heating output. This capability can be of major importance in relation to corrosion inhibition, as covered more particularly in the previously mentioned application of J. E. Bridges, Ser. No. 322,930, filed concurrently herewith, now U.S. Pat. No. 5,012,868.

Figure 5:
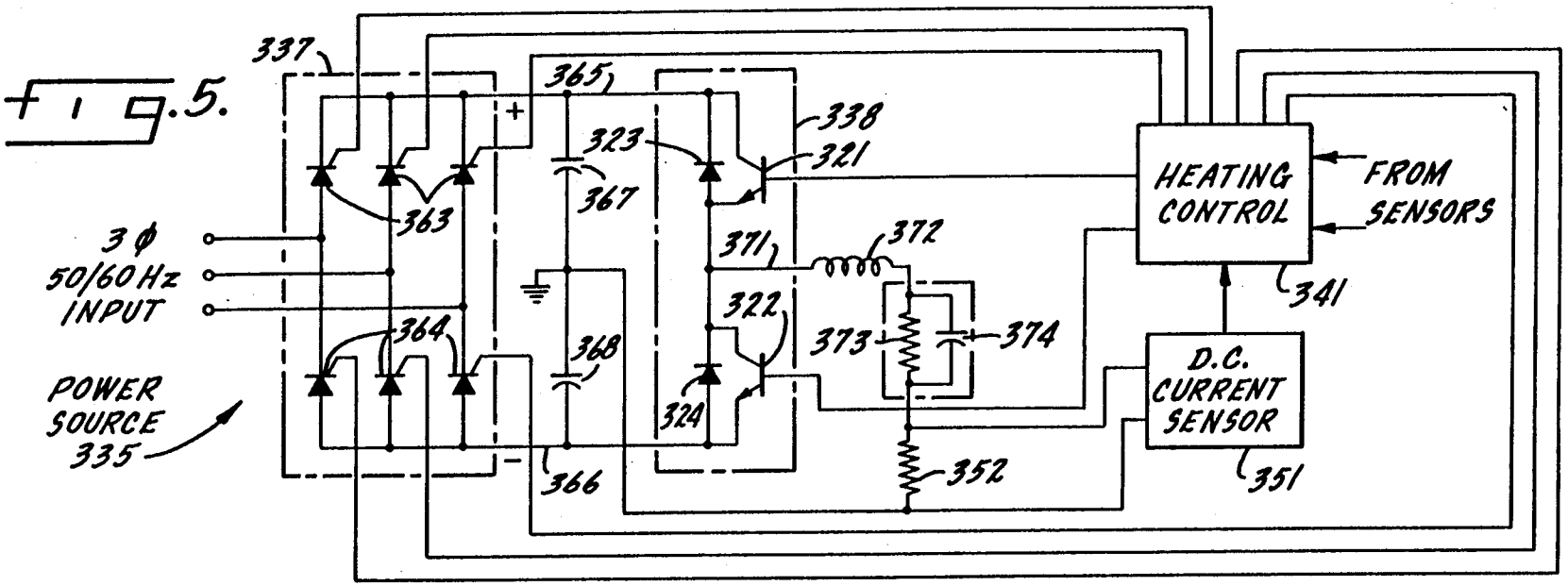
FIG. 5 is a circuit schematic for another power source constructed in accordance with the present invention.

FIG. 5 illustrates another power source 335 that may be utilized in the heating systems of wells such as those of FIGS. 1 and 2. Power source 335 constitutes a pulse width modulation (PWM) inverter, corresponding to a type of circuit that has been utilized in variable speed electronic motor drives. It includes an A.C. to D.C. converter circuit 337 having three forwardly polarized SCRs 363 each having its anode connected to one lead of a three phase 50/60 Hz input. Converter 337 further comprises three oppositely connected SCRs 364, connected to the same A.C. supply lines. A positive output conductor 365 for the converter is connected to the cathodes of all of the SCRs 363. Similarly, a negative output conductor 366 is connected to the anodes of the reverse polarity SCRs 364. It will be recognized that the current-carrying capacity of converter 337 may be increased by the use of additional SCRs in parallel with devices 363 and 364; the voltage withstand capabilities of the converter can be increased, if required, by further SCRs in series with devices 363 and 364. A filter capacitor 367 is connected from the positive polarity output line 365 to ground; similarly, a filter capacitor 368 is connected from conductor 366 to ground.

The solid state switching circuit 338 in power source 335, FIG. 5, comprises two ON/OFF power transistors (or GTO thyristors) 321 and 322. The collector of transistor 321 is connected to the positive polarity output conductor 365 from conversion circuit 337. The emitter of transistor 321 is connected to a frequency limiting inductance 372 that is in turn connected to a load 373 representing the overall impedance of the main heating circuit in one of the oil wells as previously described. A capacitor 374 is shown connected in parallel with load 373; capacitor 374 may be considered as including the inherent capacitance of the heating circuit. Load impedance 373 is returned to ground, the return connection being shown as made at the junction of filter capacitors 367,368. A diode 323 is connected across the emitter and collector of transistor 321. The circuit connection for power transistor 322 is similar to that of transistor 321. In this instance, the emitter is connected to the negative conductor 366 in the output from rectifier 337 whereas the collector is connected to the load circuit comprising inductance 372 and load 373. A diode 324 is connected across the collector and emitter of transistor 322.

Power source 335 includes a heating control circuit 341 having appropriate input connections from sensors such as the sensors 43–46 and 143–149 of FIGS. 1 and 2, respectively. Heating control circuit 341 has output connections to the bases of the two ON/OFF transistors 321 and 322 and to the gate electrodes of all of the SCRs 363 and 364 in converter circuit 337. A D.C. current sensor 351 with an appropriate input resistance 352 may be provided for use in controlled corrosion inhibition.

Figure 6B:
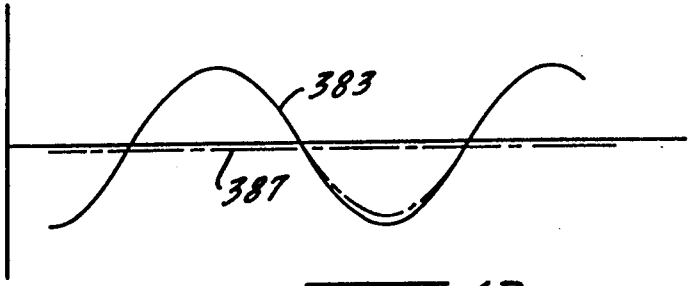
FIGS. 6A and 6B are electrical waveforms used in explanation of operation of the circuit of FIG. 5.
Figure 6A:
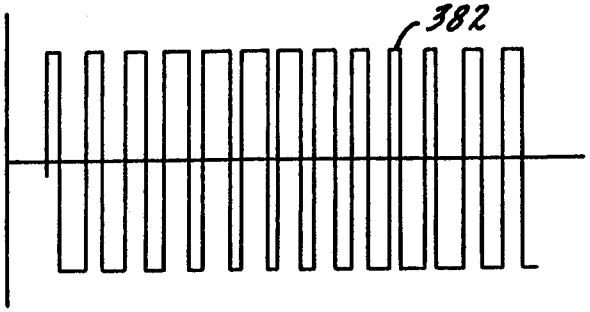

The output from power source 335, as it appears on conductor 371, corresponds generally to the idealized waveform 382 in FIG. 6A. That is, the output of power source 335 of FIG. 1 is a pulse width modulated (PWM) square wave generated by the ON/OFF power transistors 321 and 322. Similar outputs can be developed by switching circuits that use GTO thyristors instead of SCRs. Power source 335 is relatively efficient, at least in comparison with audio amplifier circuits. Furthermore, its output waveform 382 can be proportionally controlled by varying the timing of the gating signals supplied to transistors 321 and 322. The output is effectively integrated or filtered to provide the low frequency wave component illustrated by the idealized curve 383 in FIG. 6B. The conductive angles of the SCRs 363 and 364 in converter 337 can be varied, by control 341, to change the amplitude of the output waveform 382 to meet changes detected by the sensors connected to the control circuit. A limited, controllable D.C. component 387, for corrosion inhibition, can also be developed by differential control of the conduction periods for the SCRs.

Power source 335, however, can be relatively expensive and may generate significant subharmonics that are transferred back into the power line from which source 335 is energized. Such subharmonics can cause flicker and otherwise disrupt operations of typical rural power systems. Accordingly, effective use of power source 335 may be dependent upon incorporation of adequate filter circuits (not shown) to minimize the subharmonic difficulties.

Figure 7:
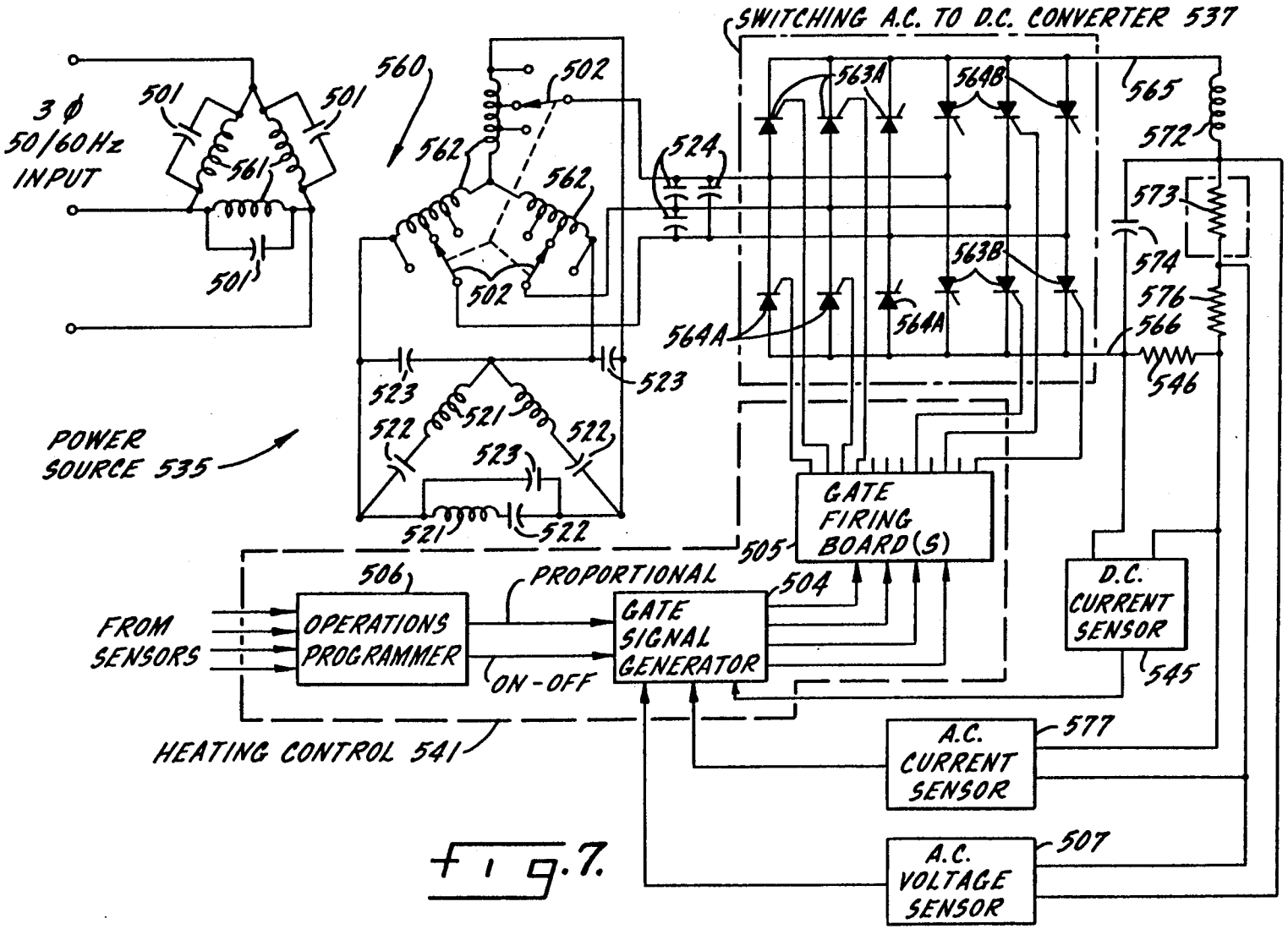
FIG. 7 is a schematic circuit diagram, partly in block form, of a preferred form of power source constructed in accordance with the invention.

FIG. 7 illustrates a power source 535 that constitutes a preferred construction for most applications in which an electromagnetic heating system for an oil well or other comparable installation is to be energized at a frequency significantly lower than the conventional power line frequencies of 50/60 Hz. Power source 535 is supplied from a three phase 50/60 Hz power line by means of an input transformer 560 having delta connected primary windings 561 and wye connected secondary windings 562. On the primary side of transformer 560 there is a capacitor 501 connected in parallel with each primary winding 561. Each secondary winding 562 of the transformer, on the other hand, is provided with a tap changer 502. The three tap selectors 502 are all interconnected mechanically for simultaneous adjustment. It should be understood that the delta-wye configuration shown for input transformer 560 is exemplary only; delta-delta, wye-wye and wye-delta configurations can all be used.

A switching converter circuit 537 in power source 535 combines the functions of an A.C. to D.C. conversion means and a solid state switching means. Circuit 537 is of a type known as a cyclo-converter; it includes three signal-controlled rectifiers 563A having their anodes individually connected to the cathodes of three other SCRs 564A. Unit 537 further includes three additional SCRs 563B individually connected, anode-to-cathode, to three other reverse polarized SCRs 564B. Each output tap 502 of transformer 560 is connected to the anode-cathode terminal of one SCR pair 563A and 564A and is also connected to the anode-cathode terminal of another SCR pair 563B and 564B.

The output of circuit 537, like the previously described converter units, comprises two conductors 565 and 566; in this instance, however, neither can be characterized as a positive polarity bus or a negative polarity bus. Instead, both conductors go positive and negative, though at different times. Conductor 565 is connected to the cathodes of all of the SCRs 563A and to the anodes of all of the devices 564B; conductor 566 is similarly connected to the SCRs 563B and 564A. The load circuit of the heating system is connected across the output conductors 565 and 566 of the combined rectifier and switching circuit 537; the load circuit includes a frequency limiting inductance 572 in series with a load 573 shown as a resistance and representative of the electrodes and connecting portions of the heating circuit in any of the previously described oil wells. A shunt capacitor 574 is shown connected across load 573, as a part of the overall load circuit; capacitor 574 represents the inherent capacitance of the load, which may be supplemented by additional capacitance to minimize application of higher harmonics to the main load impedance 573. A shunt resistance 576 may be included in series in the load circuit to afford an input to an average current sensor 577.

Current sensor 577, which is essentially equivalent to a conventional averaging ammeter, supplies an input signal to a gate signal generator 504 that is a part of the heating control 541 of power source 535. Gate signal generator 504 is connected to a gate firing board or boards 505 having a multiplicity of outputs, one for each of the gate electrodes of SCRs 563A, 563B, 564A, and 564B. Gate signal generator 504, in addition to its input from the current sensor 577, has additional inputs derived from an operations programmer 506 that receives inputs from appropriate temperature and flow sensors (e.g. sensors 143–149, FIG. 2). Gate signal generator 504, as shown in FIG. 7, also receives an input signal from an applied voltage sensor circuit 507 that is connected across load impedance 573. A D.C. current sensor 545, connected to an appropriate low resistance 546 in the heating circuit, may also afford an input to gate signal generator 504 for control of a low-amplitude corrosion inhibition current.

At the input to power source 535, each capacitor 501 serves as a part of a power factor correction circuit. The tapped secondaries 562 of input transformer 560 afford a convenient and effective means for major adjustments of the power supplied to the load circuit 572–574 energized from the power source. The SCRs in the A.C. to D.C. converter unit 537 are connected in a complete three-phase switching rectifier bridge that supplies positive and negative-going power to both of the conductors 565 and 566; the SCRs are fired in sequence, in a well-known manner, under control of gate firing signals from circuit 505 of heating control 541.

Figure 8A:
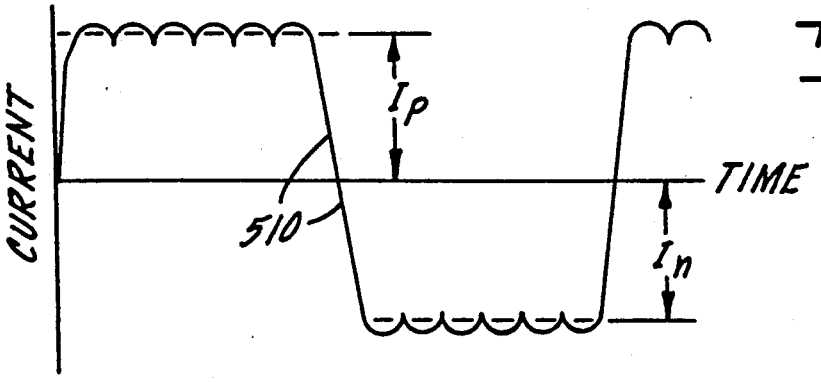
FIGS. 8A–8C are electrical waveforms diagrams utilized in explanation of the operation of the power source of FIG. 7.

Power source 535 supplies heating power to load 573 with a waveform 510 approximating that of a square wave, as illustrated in FIG. 8A. The positively polarized SCRs 563A and 563B supply the positive portions of the square wave signal, being fired to develop that portion of the electrical power supplied to the load, whereas the SCRs 564A and 564B are fired to produce the negative portions of waveform 510. The ripple, in waveform 510, is from the 50/60 Hz input.

Figure 8B:
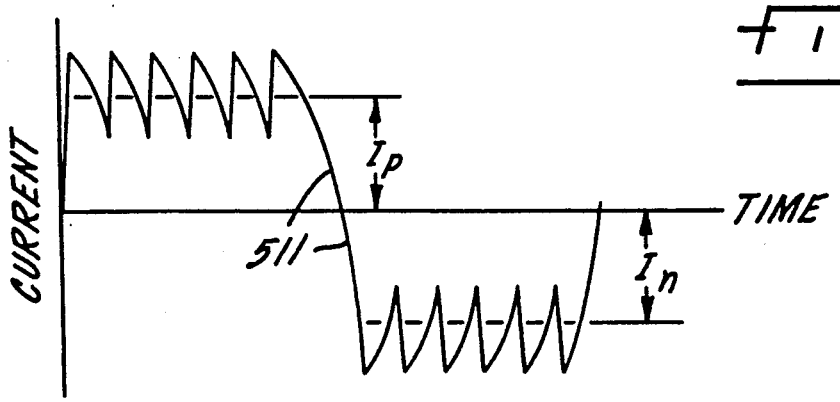

By delaying the firing of the positive-going SCRs 563A and 563B, the amplitude of the positive portion of waveform 510 can be modified and the positive-going current $I_p$ can be reduced in amplitude as shown in FIG. 8B, waveform 511. Similarly, by delaying the firing of the negative-going SCRs 564A and 564B, the amplitude $I_n$ of the negative portions in the pseudo square wave can be reduced, particularly as shown by the negative half cycle of waveform 511 in FIG. 8B. Symmetrical alteration of the timing of firing of the SCRs provides effective proportional duty cycle control, reducing the overall amplitude of the pseudo square wave as supplied to load 573 and thus reducing the power applied to downhole heating. It should be noted, however, that this is subject to some limitations imposed by the power factor requirements of the electrical utilities from which the power is initially derived.

The timing of the firing signals supplied from circuit 505 to the SCRs in rectifier 537 is controlled from gate signal generator 504, in turn controlled by the operations programmer circuit 506, which can select either proportional duty cycle control or ON/OFF (bang-bang) control for the SCRs. When the latter expedient is selected by circuit 506, the heating rate control is limited to that afforded by the adjustable taps 502 on the secondary windings of transformer 560. Operations programmer 506 may be made responsive to various sensors, including those at the top of the well and sensors positioned downhole of the well in the vicinity of the main heating electrode. The sensor inputs to programmer 506 are employed, particularly when proportional control is being exercised, to maintain the operating temperature of the main heating electrode within appropriate limits in order to maximize its effective life and to preclude unwanted side effects, including vaporization of liquids in the well, due to excessive temperatures.

Figure 8C:
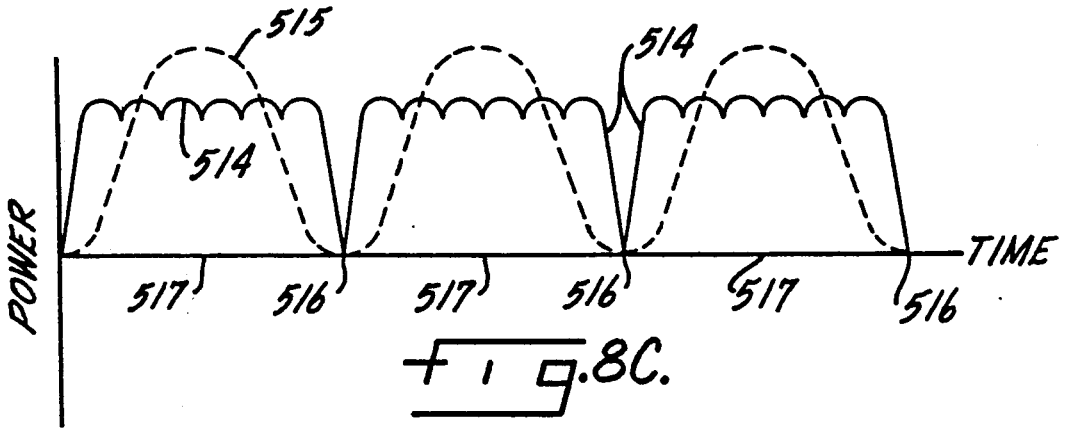

Curve 514, FIG. 8C, shows the power consumption characteristic of a heating system using the cyclo-converter power source 535, FIG. 7; curve 514 corresponds to voltage curve 510, FIG. 8A. FIG. 8C also includes a second curve 515 that affords the same power consumption data for a pulse width modulator power source such as circuit 335, FIG. 5. Both power curves 514 and 515 have a repetition frequency of twice the heating frequency, with distinct nulls at points 516; it is assumed the heating frequencies are the same for the two sources. The "valleys" between power peaks are more pronounced for the PWM source 335, curve 515, than for the cyclo-converter power source 535, curve 514; this is one of the advantages of the cyclo-converter. For either, however, the "flicker", at twice the heating frequency, may require correction.

Proportional control, exercised by varying the duty cycle of the switching apparatus in the power source, is a highly desirable form of control for the mineral well power sources of the present invention. With proportional control, power can be applied on a continuous basis, without abrupt changes, avoiding the high peak power consumption that may occur with a bang-bang control approach. On the other hand, with the utilization of proportional control, particularly in a cyclo-converter as in FIG. 7, or indeed in any D.C. supply controlled by gated SCRs, it may be difficult to maintain a power factor adequate to meet utility company requirements. This can be particularly undesirable in those circumstances in which the utility imposes rate penalties if the power factor drops below a given level (e.g. 0.9).

Power factor correction capacitors may be applied to the input transformer of the power source to aid in overcoming this problem. That is one purpose of capacitors 201 in power source 235 (FIG. 3) and especially capacitors 501 in power source 535 (FIG. 7). These capacitors should be sized so that they will just neutralize lagging reactance in the heating system at a relative output voltage of about ninety percent of maximum for a given tap of the power source, assuming a minimum power factor of 0.9 specified by the utility. This causes the power factor to be approximately unity at ninety percent of the maximum output voltage. In these circumstances, when the output voltage is at its maximum the power factor is leading at approximately 0.9; as the amplitude of the voltage supplied to the heating electrodes drops to ninety percent, the power factor reaches unity. With a continued voltage reduction to approximately eighty percent maximum, the power factor decreases to 0.9 lagging. Thus, the power source, with appropriate input capacitance, can afford effective proportional control over a voltage change of approximately twenty percent, equivalent to a forty percent variation in power supplied to the heating system of the well.

To extend the range of effective amplitude control while still maintaining a power factor of 0.9 or more, tap changers on the input transformer can be used, as shown in FIG. 7. The tap adjustments can be on either the primary or the secondary of the transformer. If each tap corresponds to a twenty percent increment of voltage, each tap change provides a new twenty percent voltage range and thus a new forty percent power adjustment capability. In this manner, with appropriate tap changing at the input transformer, or on an output transformer, it is possible to obtain proportional control over a wide amplitude range while maintaining the power factor or phase angle within acceptable limits.

Tap changes, of course, are also highly useful in connection with a bang-bang control for a cyclo-converter, in which the firing angle is adjusted for the maximum pulse width; in these circumstances, the power factor is usually about 0.85 lagging. With appropriate adjustment, the ratio of average power to peak power can be kept within limits such as to reduce demand charges from a utility supplying 50/60 Hz power. For a single well operating from a given power line, tap changes of the order of about twenty percent with respect to voltage (forty percent power) are a reasonable compromise as a trade-off of the number of taps on the transformer with the prospects of demand charge costs. Under an arrangement of this kind, the maximum ratio between peak and average power will be no more than about thirty percent to forty percent and may be as low as twenty percent. Even better performance may be achieveable by effective coordination of a plurality of wells energized from a single power line. Reducing harmonics of low frequencies used for heating (e.g., 0.01 Hz to 35 Hz) may be rather difficult. These harmonics appear as side bands of power line (50/60 Hz) harmonics and are spaced at subharmonic intervals around the main harmonics. For suppression of the undesired harmonics, broad band or selective filtering may be required. Such filtering may involve the use of shunt capacitors such as capacitors 501 in power source 535, FIG. 7, which may also have to be employed for power factor correction as previously discussed. But these shunt capacitors can lead to resonances in which reactive power is exchanged between the capacitors and low impedance inductive reactance elements in the utility power grid. In those instances in which the volt-ampere capacity of the power source is an appreciable fraction of the short circuit volt-ampere capacity of the power system, the resonances can occur at harmonic frequencies generated in the cyclo-converter itself.

To avoid such undesirable resonances, several remedial actions are available. One is to connect a series resonant circuit across each phase in the input transformer to the rectifier and switching circuit in the cyclo-converter as indicated by the inductances 521 and capacitances 522 in FIG. 7. These series resonance circuits, in effect, supply the required harmonic current flow, rather than the input power line, and thereby prevent excitation at spurious resonances. However, such series resonant circuits may be relatively expensive and may be made unnecessary by other techniques.

Another technique to avoid undesired resonances is to monitor current passing through the power factor correction capacitors such as capacitors 501 in FIG. 7. If a resonant or near resonant condition is observed, it can be effectively detuned by changing the firing angle of the SCRs in circuit 537 of the overall cyclo-converter. Such a monitoring system may be utilized as a part of an overall arrangement not only to suppress harmonics but also to reduce the cost of harmonic suppression.

Other methods of harmonic suppression include use of shunt capacitors, similar to capacitors 501 but each connected in series with a resistor. Such circuits can be designed to materially reduce higher order harmonics. Also, shunt capacitors, like capacitors 501, each in series with an inductor, may be used, tuned to selectively remove specific harmonics. Other expedients that may be useful in harmonic suppression are the connection of capacitors 523 across the high voltage taps of the secondary of transformer 560. Another useful technique of the same kind comprises three capacitors 524 connected across the input lines to the SCRs in switching rectifier unit 537. These capacitors, particularly capacitors 523, may in part serve a power factor correction function, but are most efficient in filtering the higher order harmonics and accompanying side bands as previously mentioned.

In each of the power sources shown in FIGS. 3, 5, and 7 means are provided for developing an intermediate D.C. output of predetermined amplitude from a conventional 50/60 Hz input, and that intermediate D.C. power is sampled by a switching means at a power frequency substantially different from the 50/60 Hz input. Some of the circuits have the A.C. to D.C. conversion means and the switching means as separate circuits; see FIGS. 3 and 5. In cyclo-converter circuits such as FIG. 7, on the other hand, the switching and conversion circuits may be combined.

In any of these power sources it may be necessary or desirable to apply power factor correction, as by using capacitors in the primary or secondary circuit of an input transformer to the power source. If higher order harmonic and side band suppression is necessary, filtering expedients of the kind described in connection with FIG. 7 may be required. Proportional control by adjustment of the timing of the A.C. to D.C. conversion and/or the sampling switches is preferred, either separately or in combination with a tapped input or output transformer. In all of the circuits, when used in a mineral well heating system that is required to heat the deposit adjacent the well, the preferred power frequency is in the range of 0.01 Hz or even lower, up to 35 Hz, most often somewhere between two and twenty Hz.

In the appended claims, references to a heating system for a "mineral fluid well" should be understood to include oil wells, gas wells, sulfur wells, and heating systems for other earth formations. It should also be understood that the heating electrodes need not be a simple pair but could also be multiple pairs of electrodes disposed in any type of media. An example of this would be to employ pairs of electrodes disposed around the producing portion of a borehole of a heavy-oil well. In this case, the heating is caused by the flow of current between the electrodes rather than from the casing of the producing well.

In addition, while the functions of the preferred design of the power supply are described in terms of semiconductor devices, substitution of other devices to replace the semiconductor devices which sample the D.C. intermediate output can also be employed.

Figure 9:
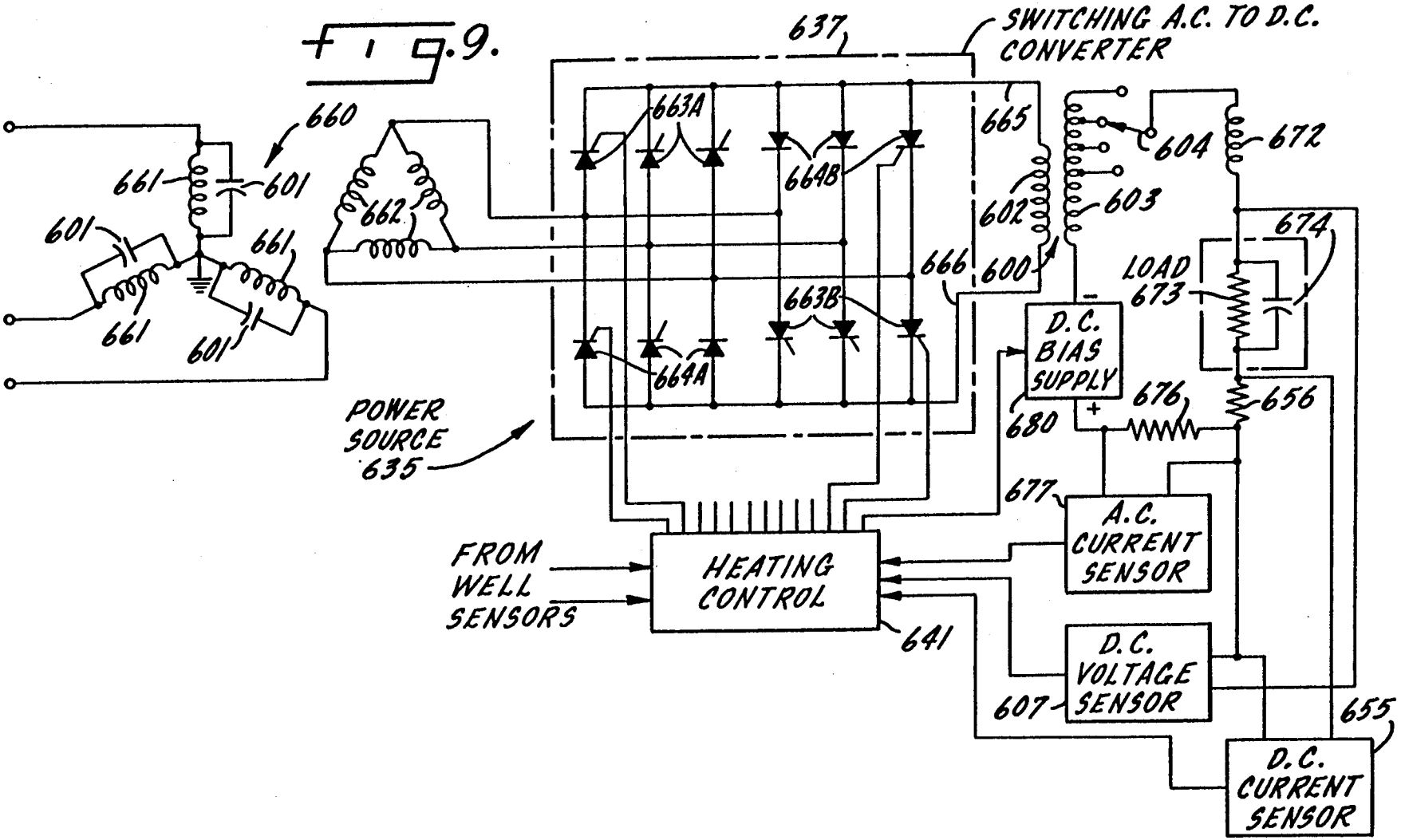
FIG. 9 is a circuit diagram of another electrical energizing circuit operable in accordance with the invention.

FIG. 9 illustrates another power source 635 that may be utilized to carry out the apparatus and method objectives of the present invention. The circuit of power source 635 includes an input transformer 660 of the wye-delta type, with power factor correction capacitors 601 connected in parallel with the input windings 661. The output windings 662 are connected to a combined A.C./D.C. converter and switching unit 637 utilizing both positively polarized SCRs 663A and 663B and negatively polarized SCRs 664A and 664B in a cyclo-converter circuit like that of FIG. 7, with two output conductors 665 and 666.

In power source 635 the output lines 665 and 666 from switching rectifier unit 637 are connected to the primary winding 602 of an output transformer 600. The secondary winding 603 of transformer 600 is equipped with a tap changer 604 to provide major changes in the amplitude of the heating current supplied to the output circuit, comprising a current limiting coil 672, a load resistance 673, and a capacitance 674. As before, load 673 represents the casing or other conductive means for supplying an A.C. heating current to a downhole main heating electrode, that heating electrode, the return electrode, and the portions of intervening earth formations between the two electrodes. As in any and all of the systems that use steel pipe, the load resistance 673 may be quite non-linear.

Power source 635 is a cyclo-converter substantially similar, in many respects, to circuit 535 of FIG. 7. It includes a heating control 641 that supplies firing signals to the gate electrodes of all of the SCRs in switching rectifier circuit 637. Heating control 641 has inputs from appropriate temperature sensors, flow sensors, and/or pressure sensors in the well and may be connected to an external computer if utilized in conjunction with other similar power sources at different wells. It also includes an A.C. current sensor 677 connected to a shunt resistance 676 in the heating circuit; the output of sensor 677 is supplied to heating control 641. A D.C. voltage sensor 607 may be connected across load 673, with its output also applied to heating control 641. A shunt resistor 656 and D.C. current sensor 655, connected to heating control 641, may also be provided.

The operation of the cyclo-converter power source 635 of FIG. 9 is essentially similar to that of circuit 535 of FIG. 7, including the waveforms illustrated in FIGS. 8A and 8B. The principal difference is that major changes in the heating current supplied to load 673 are achieved by tap changer 604 in the secondary of the output transformer 600 (FIG. 9) rather than by the tap changers 502 on the secondary of input transformer 560 (FIG. 7). The other principal difference is that the presence of output transformer 600 in the circuit precludes effective development of a corrosion inhibiting D.C. bias on load 673 through control of the gating signal supplied to the SCRs in switching rectifier circuit 637. Instead, a separate D.C. bias supply 680 is included in the heating circuit comprising load 673.

D.C. bias supply 680 might include an A.C. powered separate D.C. bias supply or it might comprise a polarization cell. But the use of either of these two expedients, employing apparatus of the kind usually used in cathodic protection arrangements for pipelines and oil wells, is quite difficult, to the extent of being impractical or in some instances even impossible. Effective, practical bias source circuits are described and claimed in the co-pending application of J. E. Bridges et al Ser. No. 322,912 filed concurrently herewith, now U.S. Pat. No. 4,919,201.

Figure 10:
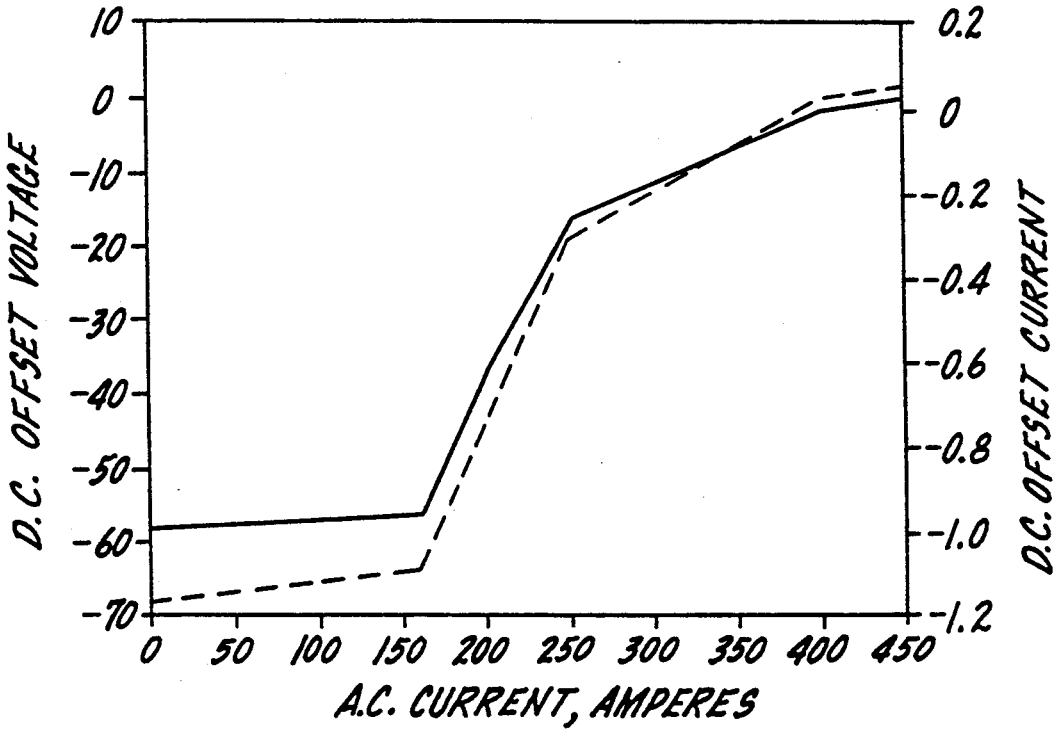
FIG. 10 is a chart of D.C. current variations responsive to changes in A.C. heating current.

For a more complete understanding of the method and apparatus of the present invention, consideration of the electrical phenomena that occur in an electromagnetic heating system for an oil well or other mineral fluid well, of the kind including a main heating electrode deep in the well and a return electrode remote from the main heating electrode, is desirable. FIG. 10 illustrates the D.C. voltage and D.C. current between a downhole main heating electrode, in a system of this kind, and each of two return electrodes. In this instance, each return electrode was the casing of an adjacent oil well. With no A.C. heating current in the system the first circuit, curve 801, had a D.C. offset voltage of about −58 millivolts and a D.C. current just under one ampere. The current in the other system, curve 802, again with no applied A.C. heating current, showed a voltage differential of approximately −68 millivolts and a current of nearly 1.2 amperes. These naturally induced voltage differentials and currents arise because of different characteristics in the metal, the electrolytes, and temperatures between the main electrode in the well under study and the return electrodes.

In the wells from which FIG. 10 was obtained, the D.C. offset current of each return electrode decreased as the A.C. heating current increased, over a range of zero to 450 amperes. However, it is equally likely that the D.C. offset current would increase, as to two or three amperes, in response to application of increasing A.C. heating excitation currents. Whether or not the D.C. offset current (and voltage) is increased or decreased in response to the A.C. heating current depends upon the materials used for the electrodes and on the electrolytes in the immediate vicinity of each of the electrodes. It should also be noted that the amplitude of the A.C. current required for well heating is a function of the flow rate of fluids from the deposit or reservoir into the well. The flow rate, and hence the heating current demand, changes appreciably over extended periods of time, and precludes the effective use of a fixed cathodic or current neutralization bias.

In considering the features and requirements of the invention, it may also be noted that use of high negative cathodic protection potentials may result in the accumulation of excessive scale on the main electrode, in this instance the main heating electrode deep in the well at the level of the mineral reservoir. An excessive accumulation of scale around the main heating electrode may plug up the perforations in that electrode or may block the screens present in many wells. The scale is also likely to interfere with electrical operation of the electrode. Thus, to achieve the full benefits of the present invention it is important to adjust the D.C. bias in accordance with changing conditions, in and around the well, to keep the D.C. corrosion protection current at a minimum. When this is done, excessive corrosion of the return electrodes is avoided, scale accumulation on the downhole main heating electrode is minimized, and well life is prolonged.

For further background, the situation of two widely separated electrodes embedded in the earth may be considered in relation to the cathodic protection concepts of the invention. Typically, the formations around each electrode have different chemical constituents; the electrode lengths are also likely to be substantially different. Under these circumstances, due to differences in lengths and in the encompassing chemical constituents, a D.C. potential is developed between the two electrodes. When these two electrodes are connected at one end only, a D.C. current flows through the interconnection, the return path being the earth formations. This is the situation for zero A.C. current in FIG. 10. Of course, this causes one of the electrodes to be positive and the other to be negative with respect to the earth. Virtually all corrosion will occur at the electrode that is positive relative to the earth. A calculation of the amount of metal loss at this positive electrode, on a worst case basis, using purely electrochemical considerations, indicates that for a current density of one milliampere per square centimeter, approximately 12 millimeters will be removed from the surface of a steel plate over a period of one year. This, of course, represents a substantial erosion rate.

The impact of D.C. currents, in situations such as those under discussion, is further illustrated in Tables 1 and 2. Table 1 shows metal thickness loss by erosion, in millimeters, over a period of ten years for an electrode 0.2 meters in diameter; it assumes a one ampere D.C. current uniformly distributed over the electrode arising, for example, from electrochemical potentials developed between two widely separated electrodes in different earth media. For a D.C. current of ten amperes, the erosion rates would be ten times as great as indicated in Table 1. A naturally occurring D.C. current of one ampere is not exceptional; see FIG. 10. Currents up to about ten amperes can occur.

Table 2 shows the impact of an A.C. voltage and resulting A.C. current applied to the same electrodes as in Table 1. For the A.C. current, rather than a D.C. current, the corrosion rates are substantially smaller. At a frequency of 60 Hz, the corrosion rate is typically only about 0.1% of that for an equivalent D.C. current density. However, theoretical considerations suggest that the corrosion rate may be approximately inversely proportional to the frequency. Thus, for a 6 Hz A.C. current, as shown in Table 2, the corrosion rate could be about ten times that occurring at 60 Hz. It should be noted that the relationships indicated between corrosion rates for A.C. and D.C. signals, in Tables 1 and 2, are nominal values and may vary, in practice, by as much as an order of magnitude above and below the values set forth in the tables.

TABLE 1

| (1 Ampere Current, D.C.) | | |
|---|---|---|
| Electrode Length, Meters | Current Density, mA/cm$^2$ | Erosion, Millimeters/ 10 Years |
| 1 | 0.16 | 18.5 |
| 10 | 0.016 | 1.85 |
| 100 | 0.0016 | 0.185 |
| 1000 | 0.00016 | 0.0185 |

TABLE 2

| (100 Ampere Current, A.C.) | | | |
|---|---|---|---|
| Electrode Length, Meters | Current Density, MA/cm$^2$ | 60 Hz Erosion mm/10 Yrs. | 6 Hz Erosion mm/10 Yrs. |
| 1 | 16 | 1.85 | 18.5 |
| 10 | 1.6 | 0.185 | 1.85 |
| 100 | 0.16 | 0.0185 | 0.185 |
| 1000 | 0.016 | 0.00185 | 0.0185 |

To improve the performance of electromagnetic downhole heating systems of the kind discussed above, it is also desirable that certain criteria be observed with respect to the return electrodes relative to the downhole main heating electrode. Thus, in a given system the return electrode should have a spreading resistance (impedance to earth) of less than twenty percent of the spreading resistance of the main heating electrode. To meet this requirement, assuming cylindrical electrodes of about the same diameter, the product of the length of the return electrode and the conductivity of the formation in which it is located should be at least five times and preferably at least ten times the product of the length of the electrode in the mineral deposit and the conductivity of the formation where it is positioned.

Moreover, over a long term of operation at high A.C. heating current densities, the return electrode, due to its limited positive potential with respect to the earth, tends to drive away water by electro-osmotic effects. If high D.C. bias and A.C. heating currents are used, it is preferable that the return electrode be made hollow and perforate, so that it can be utilized to introduce replacement water into the surrounding earth; see FIG. 1. Thus, perforations 36A in return electrode 36 not only allow water to be injected into the earth formations 23 immediately surrounding that electrode, but also allow gases to enter the electrode; such gases are often developed in the area immediately surrounding the electrode.

In some localities, provision should be made to prevent accumulation of replacement water within the upper portions of the return or sacrificial electrodes 36. Such an accumulation of water could prevent the escape of gas developed around the electrode. A simple gas-lift pump activated to reduce the water head periodically, or the use of a gas permeable (but not water permeable) pipe within the return electrode, could be employed. Because the gas evolved at the anode in an electrochemical process is usually oxygen, a simple removal method is to bubble methane through the water in the return electrode for combination with the oxygen, in the presence of an appropriate catalyst.

When the A.C. heating power source is operating at 0.01 to 35 Hz, as preferred, and the output is directly connected to the electrodes, limited asymmetry in sampling of a rectifier circuit output to obtain any desired D.C. bias voltage and current is preferred over other bias source expedients. In the following claims, any reference to an A.C. to D.C. converter for developing an intermediate D.C. output followed by a circuit which repetitively samples the intermediate D.C. output should be interpreted to include the same function in a cyclo-converter, wherein both development of the D.C. output and sampling are performed simultaneously.

We claim:

1. An electrical heating power source for a heating system for heating a zone in a subterranean formation, the heating system including the power source, a main electrode positioned in the zone to be heated, at least one sensor in the well for sensing a parameter relating to fluid pressure, fluid temperature, fluid level, fluid flow rate, or fluid constituency in the well or in the deposit, and a return electrode, the power source comprising:

A.C. heating current generator means for generating a high amplitude A.C. heating current, of at least fifty amperes, at a heating frequency in a range of 0.01 Hz to 35 Hz;

the A.C. heating current generator means including A.C. to D.C. conversion means for developing an intermediate D.C. output of predetermined amplitude from a conventional 50/60 Hz power input, input connection means for connecting the power source to a 50/60 Hz supply, an input transformer coupling the input connection means to the conversion means, and switching means, connected to the conversion means, for repetitively sampling the intermediate D.C. output of the conversion means at the heating frequency to develop the high amplitude A.C. heating current at the heating frequency, the conversion means and the switching means being combined in one circuit comprising a plurality of gated rectifiers;

heating control means, connected to the heating current generator means and having an input derived from the sensor, for controlling the heating frequency and the energy content of the A.C. heating current in accordance with changes in said parameter, the heating control means including at least one tapped winding on the input transformer and comprising means for varying the relative duty cycles of the gated rectifiers by applying a predetermined sequence of gate signals to the gated rectifiers at the heating frequency; and output connection means for connecting the A.C. heating current to the electrodes.

2. An electrical power source for a mineral fluid well heating system, according to claim 1, in which:

the input transformer is a three-phase transformer; and the power source further comprises three power factor correction and filter capacitors, each connected in parallel with a winding on one side of the transformer.

3. An electrical power source for a mineral fluid well heating system, according to claim 2, and further comprising three series resonant circuits, each resonant at a harmonic of the heating frequency, and each connected in parallel with one of the power factor correction and filter capacitors.

* * * * *